US005339133A

United States Patent [19]

Otomo et al.

[11] Patent Number: 5,339,133

[45] Date of Patent: Aug. 16, 1994

[54] IMAGE FORMING APPARATUS INCLUDING PROCESS CARTRIDGE WITH MAGNETIC CONNECTOR

[75] Inventors: Naoki Otomo; Atsuo Ohmura; Toshio Shida, all of Hachioji, Japan

[73] Assignee: Konica Corporation, Tokyo, Japan

[21] Appl. No.: 60,343

[22] Filed: May 11, 1993

[30] Foreign Application Priority Data

May 19, 1992 [JP] Japan ..... 4-032942

[51] Int. Cl.[5] ..... G03G 15/00

[52] U.S. Cl. ..... 355/200; 439/38

[58] Field of Search ..... 355/200, 210, 211; 439/38–40

[56] References Cited

U.S. PATENT DOCUMENTS 5,210,574 5/1993 Kita ..... 355/211

FOREIGN PATENT DOCUMENTS 4-127166 4/1992 Japan ..... 355/211

*Primary Examiner*—Joan H. Pendegrass

*Attorney, Agent, or Firm*—Jordan B. Bierman

[57] ABSTRACT

An image forming machine in which a detachable process cartridge having a photoreceptor drum is provided. On the frame of the process cartridge, a magnetic connector is provided, in which a magnet and an outer plate surrounding the magnet are assembled, and a leaf spring is provided between the frame and the magnet. The process cartridge is positively grounded through the magnetic connector when the process cartridge is fully inserted into the main body of the machine, due to the magnetic connection to a plate of the main body.

1 Claim, 4 Drawing Sheets

IMAGE FORMING APPARATUS INCLUDING PROCESS CARTRIDGE WITH MAGNETIC CONNECTOR

BACKGROUND OF THE INVENTION

The present invention relates to an image forming apparatus such as an electrophotographic copying apparatus, electrostatic recording apparatus or the like, and more particularly to grounding of a photoreceptor drum in the image forming apparatus.

In an image forming apparatus such as an electrophotographic copying apparatus, an electrostatic recording apparatus or the like, a desired image is obtained by the following operations: an image carrier is used which is a rotation type photoreceptor drum having a photoconductive light sensitive layer on its circumferential surface; after the light sensitive layer has been charged, a document image is exposed while the photoreceptor drum is being rotated; thereby, an electrostatic latent image of the document is formed on the light sensitive layer; toners are adhered onto the electrostatic latent image by developing units so as to form a visual image; and the obtained toner images are transferred onto a recording sheet, and the sheet is fixed so as to obtain the desired image.

The image carrier, which is a photoreceptor drum, is structured as an integral unit which can be detachably provided in the image forming apparatus main body together with a charger, developing units, and a cleaning unit, and forms a process cartridge. The process cartridge can be attached to and detached from the apparatus main body, when necessary, for inspection, cleaning, and repair of the apparatus, or in the case of replacement of the cartridge, when its life has expired. The image forming apparatus structured as described above is widely marketed because of its superior maintainability.

The photoreceptor drum which is incorporated in the process cartridge is pivotally provided in a casing of the cartridge, and is rotated by the driving force from a rotational driving section at a constant speed in the predetermined direction. Further, the rear surface of the photoreceptor drum is directly grounded, or grounded through an appropriate power source so as to obtain an excellent image. Therefore, the process cartridge is structured in the manner that: it is guided through a guide member provided between the process cartridge and the apparatus main body, to be attached to and detached from the apparatus; a positioning pin provided to the process cartridge is inserted into a receiving hole of the apparatus main body, at an end position of the process cartridge insertion; positioning of the process cartridge with respect to the apparatus main body is carried out; and at the same time, grounding is carried out through the positioning pin and the receiving hole.

When the process cartridge is loaded in the apparatus main body, it is necessary to ground the photoreceptor drum, which is incorporated into the process cartridge, to the apparatus main body. In this case, as described above, the method for grounding is carried out as follows: the positioning pin provided on the process cartridge is connected with the receiving hole, which is provided to the apparatus main body, when the process cartridge is loaded in the apparatus main body.

As described above, in the case of connection of the positioning pin with the receiving hole, the connection relies on point contact or line contact, and therefore, positive electrical connection such as surface connection due to surface contact is not always perfectly accomplished. Especially, when the accuracy of parts, the accuracy of assembly, or the like is not so good, the electrical connection becomes more unstable. Under the above described condition, the electrostatic latent image formed on the photoreceptor drum can not be stable and of high quality, so that the developed image can not be of high quality, either.

SUMMARY OF THE INVENTION

The object of the present invention is to provide an image forming apparatus in which grounding of a photoreceptor drum can be carried out simply and stably at low cost, and thereby a high quality image can be obtained.

The first embodiment to accomplish the foregoing object is described as follows: an image forming apparatus is attachably and detachably provided with a process cartridge, which has at least a photoreceptor drum therein; when the process cartridge is loaded in the apparatus main body, the process cartridge is fixed at a predetermined position in the apparatus main body by a magnetic connector; and the photoreceptor drum is grounded through the magnetic connector.

Further, the second embodiment is described as follows: a plate to be connected, by which the magnetic connector is surrounded, and a base plate, on which the magnetic connector is mounted, are conductively contacted through a spring member provided therebetween.

DETAILED DESCRIPTION OF THE PREFERRED EMBODIMENTS

Referring to the attached drawings FIG. 1 to FIG. 4, an example of an image forming apparatus of the present invention will be described as follows.

Figure 1:
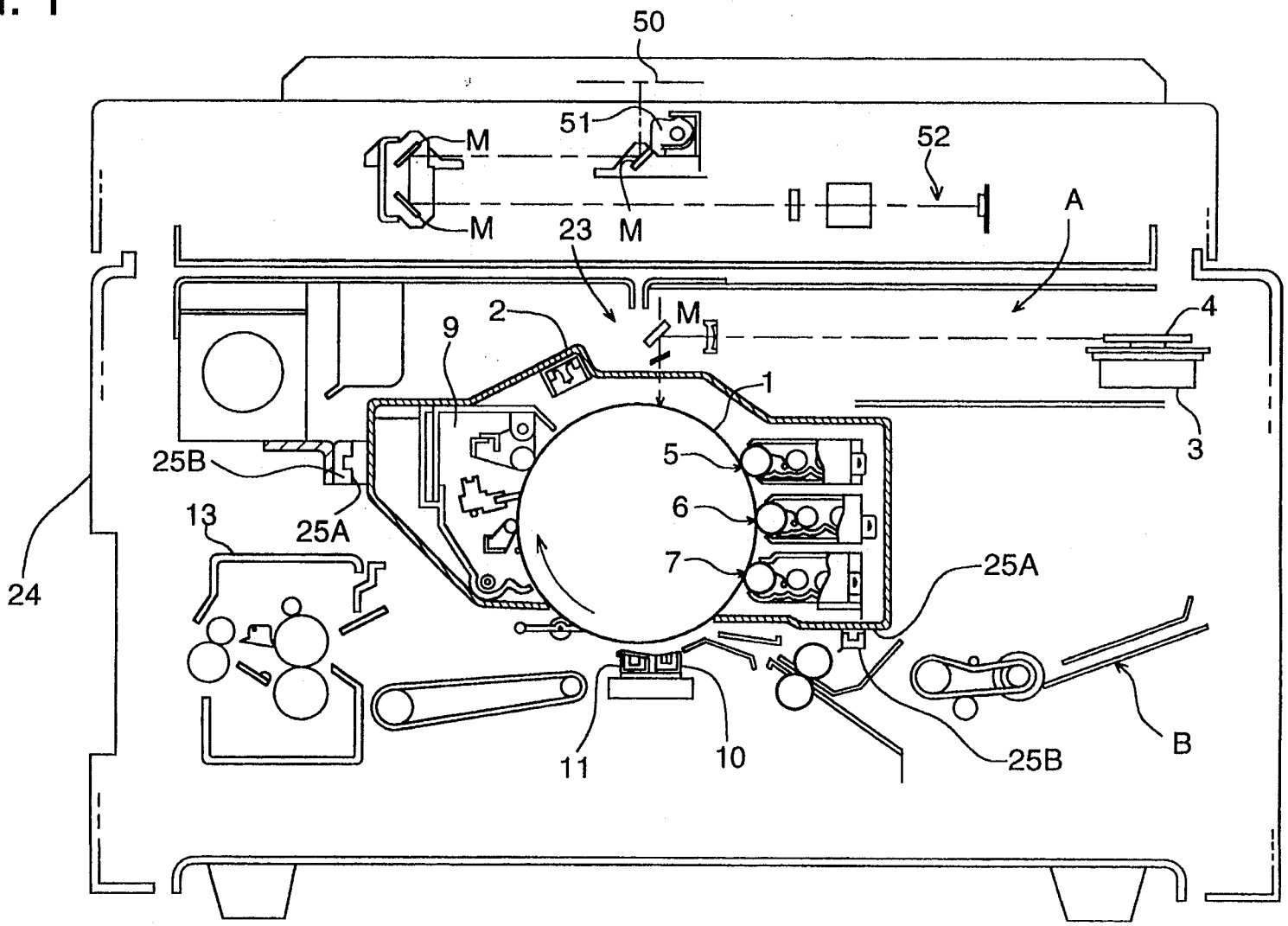
FIG. 1 is a schematic view of an image forming apparatus according to the present invention.

FIG. 1 is a schematic view showing the internal structure of the image forming apparatus according to the present invention. Referring to FIG. 1, general functions of the image forming apparatus will be described as follows. FIG. 1 is a view showing a color image forming apparatus.

A photoreceptor drum 1 is formed by vapor depositing or coating an photoconductive photosensitive layer on the surface of an electrically conductive support cylinder.

The photoreceptor drum 1 is rotated in a predetermined direction at a predetermined speed by the driving force from a driving section not shown in the drawing.

Numeral 2 is a charger for use in electric charging which is disposed near and above the photoreceptor drum 1. The charger 2 conducts corona discharging, and successively charges the surface of the photoreceptor drum 1 synchronously with its rotation in the arrowed direction.

A document 50 is illuminated by a light source 51. An optical image of the document is read as follows: an optical path of a reflected light from the document is deflected by a reflection mirror M; and the optical image is read by an image reading unit 52 which is composed of a picture-taking lens or a plurality of CCDs. An image signal outputted from CCDs in the reading means is signal-processed in a signal processing section.

A color signal which is color-separated corresponding to colors of toner is inputted from the signal processing section into a writing unit A.

In the writing unit A, a laser beam generated from a semiconductor laser scans the image through a polygonal mirror 4 which is rotated by a driving motor 3, passes through an F$\theta$ lens. Then, an optical path of the laser beam is deflected by the reflection mirror M, and the laser beam irradiates the surface of the photoreceptor drum 1.

When scanning is started, the laser beam is detected by an index sensor, and modulation of the laser beam by a first color signal is started. The modulated beam scans the surface of the photoreceptor drum 1 which is uniformly charged in advance by the charger 2. A latent image corresponding to a first color, for example, cyan, is formed on the surface of the photoreceptor drum 1 by primary scanning by laser beams and subsidiary scanning by rotation of the photoreceptor drum 1. The latent image is developed by a developing unit 5 in which cyan toner is loaded, and a cyan toner image is formed on the surface of the photoreceptor drum 1. The toner image obtained as described above, passes through a portion opposite a cleaning unit 9, which is separated and withdrawn from the surface of the photoreceptor drum 1, while the toner image is on the surface of the photoreceptor drum, and the operation enters the next image forming cycle. The surface of the photoreceptor drum 1 is uniformly charged by a charger 2.

Next, a second color signal outputted from the signal processing section is inputted into the writing unit A, and is written onto the surface of the photoreceptor drum so as to form a latent image. The latent image is developed by a developing unit in which a second color toner, for example, a magenta toner is loaded. A magenta toner image is formed in the manner that it is superimposed on the cyan toner image which has been formed in advance on the surface of the photoreceptor drum.

Further, a third color signal outputted from the signal processing section is inputted into the writing unit A, and is written onto the surface of the photoreceptor drum in the same manner as those of the first and second color signals so as to form the latent image. The latent image is developed by a developing unit 7 in which a third color toner, for example, a yellow toner is loaded. A yellow toner image is superimposed on the cyan toner and magenta toner images which have been formed in advance on the surface of the photoreceptor drum.

AC and DC bias voltage are impressed upon developing sleeves in the developing units 5, 6, and 7, and jumping development is conducted using two-component developer.

The superimposed toner image thus obtained is transferred onto a recording sheet, which is a transfer body sent from a sheet feeding section B, by a transfer electrode 10. The transfer sheet, onto which the toner image is transferred, is separated from the surface of the photoreceptor drum 1 by a separation electrode 11, conveyed to a fixing unit 13 so as to fix the sheet, and then the image is recorded onto the sheet.

A cleaning unit 9 removes unnecessary toners remaining on the surface of the photoreceptor drum after the transfer operation has been completed.

Numeral 23 is a process cartridge which is structured as an integral unit composed of the photoreceptor drum 1, charger 2, developing units 5, 6, 7, and cleaning unit 9. The process cartridge 23 is detachably provided with a travelling means of rails 25A which fits into guide rails 25B provided on the main body 24 of the image forming apparatus. Accordingly, the photoreceptor drum 1, charger 2, developing units 5, 6, 7, and cleaning unit 9 in the cartridge 23 can be attached to and detached from the main body 24 in a direction perpendicular to the surface of FIG. 1 under the condition that they are disposed in the cartridge 23.

Figure 2:
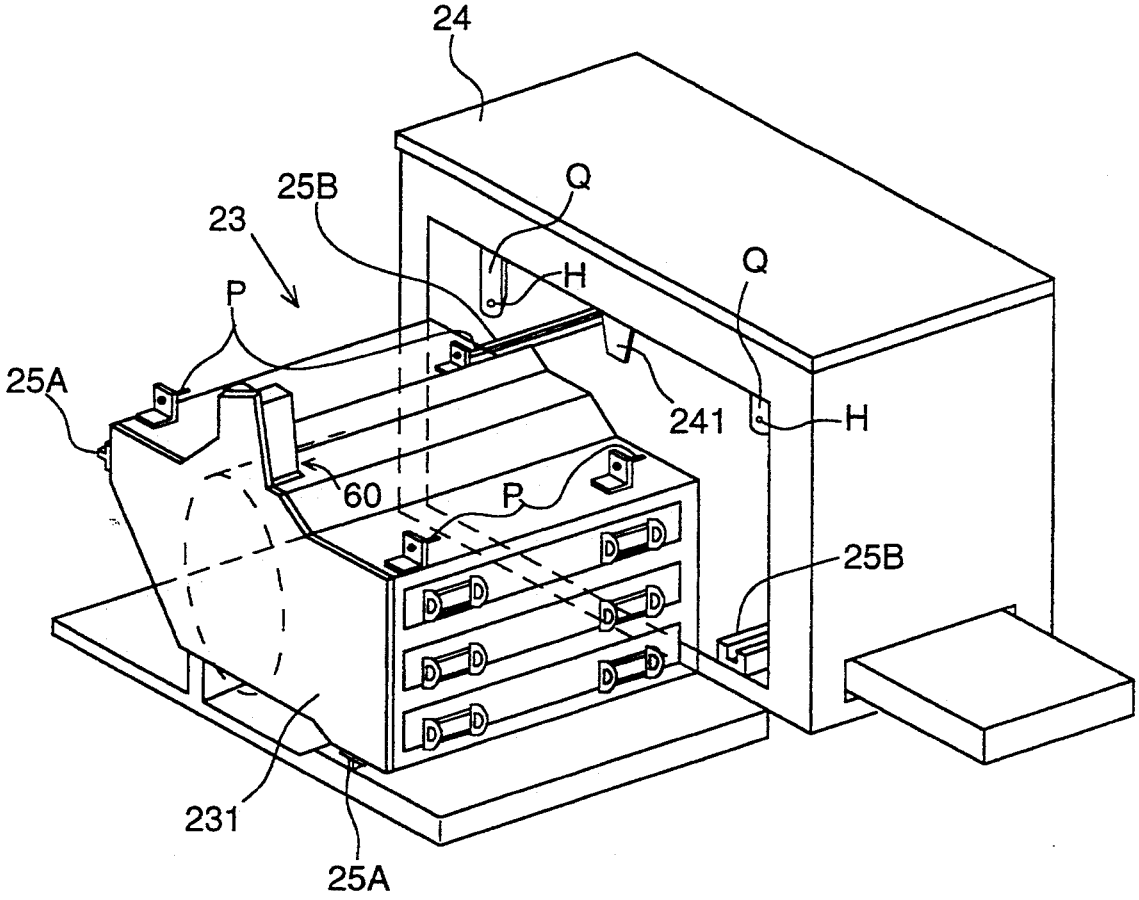
FIG. 2 is a perspective view showing the image forming apparatus when a process cartridge is drawn out from the apparatus.
Figure 3:
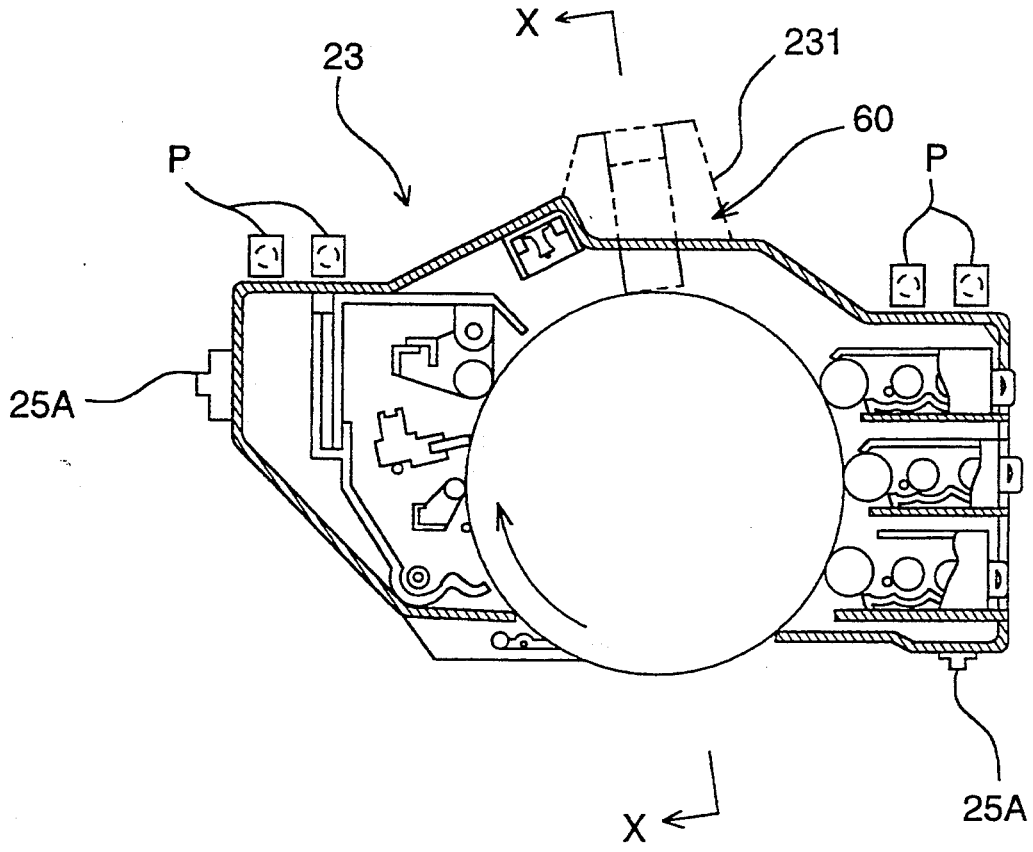
FIG. 3 is a front view showing the process cartridge of the image forming apparatus according to the present invention.

FIG. 2 is a perspective view in which the process cartridge 23 is withdrawn from the main body 24. FIG. 3 is a front view of the process cartridge 23 itself.

In FIG. 2 and FIG. 3, two positioning pins P are provided on the left upper portion of the process cartridge 23, and another two positioning pins P are provided on the right upper portion of the process cartridge 23, wherein total four positioning pins P are disposed along the direction, in which process cartridge 23 is withdrawn, in the manner that the front and rear pins are not in line. Rails 25A are engaged with guide rails 25B of the main body 24 so as to insert the process cartridge 23 into the main body 24. When the process cartridge has been inserted into the main body, positioning pins P of the process cartridge 23 are inserted into receiving holes H provided in hanger sections Q provided on the main body 24. The position of the process cartridge 23 is determined by the four pins in the front and rear portions of the process cartridge 23.

A process cartridge base plate 231 is provided on the front surface of the process cartridge 23. A magnetic connector 60, which connects with a panel provided on the main body 24 so as to fix the process cartridge 23 to the main body 24 when the process cartridge 23 has been inserted into the main body 24, is provided on the process cartridge base plate 231.

Figure 4:
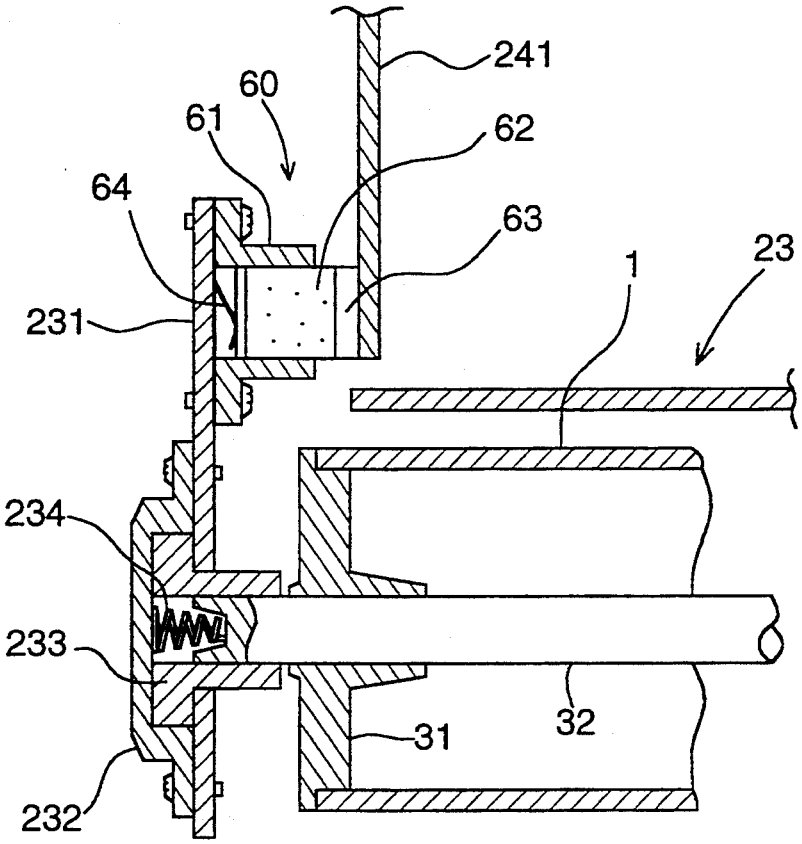
FIG. 4 is a vertical sectional view which is taken on line X—X and viewed in the arrowed direction in FIG. 3.

FIG. 4 is a sectional view which is taken on line X—X in FIG. 3 and viewed from the arrowed direction. FIG. 4 shows the condition in which the magnetic connector 60 connects with a main body earth panel 241 provided on the main body so that the process cartridge 23 is fixed to the main body.

In FIG. 4, numeral 1 is a photoreceptor drum, on both ends of which drum flanges 31 are provided (in FIG. 4, only the left side of the photoreceptor drum 1 is shown). A photoreceptor drum shaft 32 is press-fitted into the rotational center of the drum flanges 31. Both ends of the photoreceptor drum shaft 32 are supported by bearings 233 such as oilless bearings, and the bearing 233 is provided to the process cartridge base plate 231 by a bearing cover 232. Cut-out portions are provided in both ends of the drum shafts 32. A conical bearing spring 234 is provided between the cut-out portion and the bearing cover 232 so that the drum shaft 32 is pushed to the center.

The magnetic connector 60 is provided on the upper portion of the left side plate of the process cartridge base plate 231 in FIG. 4, wherein a leaf spring 64 is sandwiched therebetween. In a magnetic connector casing 61 of the magnetic connector 60, a plate to be connected 63, by which a magnet 62 is surrounded, is incorporated. The leaf spring 64 pushes the plate to be connected 63 to the right direction, however a wide portion of the plate 63 is prevented from moving more to the right direction by a wide step portion provided inside the magnetic connector casing. When the process cartridge 23 has been inserted into the main body, just on the above-described condition, the right side surface of the plate 63 is connected to an earth panel provided on the main body so as to fix the process cartridge 23 in the position.

The above-described members, that is, the photoreceptor drum 1, drum flange 31, drum shaft 32, bearing 233, bearing cover 232, bearing spring 234, process cartridge base plate 231, leaf spring 64, plate to be connected 63, and main body earth panel 241 are made of metallic or conductive members. The photoreceptor drum 1 is in contacted with each member. Therefore, the photoreceptor drum 1 is fully and stably grounded to the main body through the earth panel provided on the main body.

Especially, when the process cartridge 23 is attached to and detached from the main body, grounding is on or off according to the contact between the plate to be connected 63 of the magnetic connector 60 and the main body earth panel 241. However, as described above, when the plate to be connected 63 is in a conductive condition, the plate 63 is connected to the main body earth panel 241 due to the magnetic force of the magnet 62, and they are surface-connected through surface contact. Further, the opposite side of the plate to be connected 63 is surface-connected with the leaf spring 64 through surface contact, the leaf spring 64 being surface-contacted with the process cartridge base plate 231, and thus stable electric conductivity can be accomplished. Accordingly, a high quality image can be always obtained on the surface of the photoreceptor drum 1.

Due to the present invention, the photoreceptor drum can be stably grounded at low cost by a simple structure, so that an image forming apparatus, by which a high quality image can be stably obtained at low cost, can be provided.

What is claimed is:

1. An image forming apparatus comprising:

(a) a process cartridge including at least a photoreceptor, detachably mountable on a main body of said apparatus;

(b) a magnetic connector provided on said process cartridge; and (c) a plate member provided on said main body, onto which said magnetic connector is connected when said process cartridge is inserted into said main body, said process cartridge being thereby grounded to said main body, and said photoreceptor being grounded through said magnetic connector, said magnetic connector comprising a magnet, outer plate surrounding said magnet, and a spring member provided between said magnet and a frame provided on said process cartridge for mounting said magnetic connector to said process cartridge, there being electric continuity between said outer plate and said frame through said spring member.

* * * * *